US005960954A

United States Patent [19]

Seybold

[11] Patent Number: 5,960,954

[45] **Date of Patent: *Oct. 5, 1999**

[54] PACKAGING FOR THERMAL TRANSFER RIBBONS

[75] Inventor: James M. Seybold, Centerville, Ohio

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/761,036

[22] Filed: Dec. 5, 1996

[51] Int. Cl.[6] ..... B65D 85/67; B65D 95/672; B65D 85/66

[52] U.S. Cl. ..... 206/389; 206/391; 206/393; 206/398; 206/414; 206/416

[58] Field of Search ..... 206/389, 391, 206/392, 393, 398, 401, 408, 414, 415, 416, 497, 316.1, 413; 242/613.5, 614

[56] References Cited

U.S. PATENT DOCUMENTS 2,631,724 3/1953 Wright .
3,151,723 10/1964 Wendt .
3,221,874 12/1965 Pitner .
3,685,644 8/1972 Cothran et al. ..... 206/497
3,931,889 1/1976 Roccaforte .
4,049,120 9/1977 Bower .
4,170,294 10/1979 Zelinski .
5,080,314 1/1992 Moyer et al. .
5,165,541 11/1992 Morita .
5,346,067 9/1994 Haufe et al. ..... 206/497
5,390,789 2/1995 Darby .

FOREIGN PATENT DOCUMENTS 2446788 4/1976 Germany ..... 206/391

*Primary Examiner*—Paul T. Sewell
*Assistant Examiner*—Anthony Stashick
*Attorney, Agent, or Firm*—Charlene Stukenborg

[57] ABSTRACT

A packaging apparatus for packaging thermal transfer ribbons and other material having similar packaging requirements is provided. The packaging apparatus includes a pair of flat pieces having protrusions for locating pairs of thermal transfer ribbons and take-up reels in close proximity. The flat pieces and protrusions include features which prevent rotation, telescoping, edge damage or contamination of the thermal transfer ribbons during shipping processes.

3 Claims, 3 Drawing Sheets

PACKAGING FOR THERMAL TRANSFER RIBBONS

The present invention relates to an apparatus for packaging thermal transfer ribbons and other material having similar packaging requirements.

BACKGROUND OF THE INVENTION

Presently, thermal transfer ribbons are packaged in individual, half-form, molded trays that contain many ribbons and their take-up reels. While protecting against rotation and separation of the ribbon and take-up reel, these half-form trays do not keep debris off the ribbon. Heat activated shrink wrap, used with other packaging methods to keep debris off, should not be used on the side of the ribbon not cradled in the half-form trays as the heat may adversely affect the thermal transfer ribbon or the wrap may be difficult to separate from the thermal transfer ribbon. Ribbons and take-up reels typically rest on their sides in the half-form trays (as opposed to on their ends), allowing the possibility of ribbon curvature being affected if a heavy force is placed on the side of the ribbon not protected in the half-form tray. Because several ribbons and take-up reels are included on one tray in several rows, the printer operator must handle bulky packaging. Also, these half-form trays are relatively expensive to form and require additional boxes to provide a multi-tray package. Additionally, if these half-form trays are to be reused, they are rather bulky to return.

Other types of materials (such as paper rolls, yarn, ball bearings) are shipped in layered arrangements that allow a row of product to be positioned on locator projections to keep the items separate (prevent lateral slipping). These materials may be shipped in packaging formed from plastics or paper material (such as papier mache or cardboard). These materials may be shrink wrapped to prevent dust and other debris from collecting on the product during shipping. Typically, the shrink wrap is pulled very tight to prevent rotation or movement of the packaged materials. However, packaging for other types of materials do not address the specific packaging requirements for thermal transfer ribbons. For example, thermal transfer ribbons must be prevented from telescoping, unwinding or edge damage caused by tightly wrapped packaging. Additionally, thermal transfer ribbons must be protected from contamination or debris which may damage the printhead of a thermal transfer printer in which the thermal transfer ribbon is mounted.

Therefore, there is a need for providing packaging which can store a plurality of thermal transfer ribbons in an economical, convenient packaging which prevents damage or contamination of the thermal transfer ribbons.

SUMMARY OF THE INVENTION

In accordance with the teachings of the present invention, an apparatus for packaging thermal transfer ribbons is provided.

It is an object of the present invention to provide an apparatus for packaging thermal transfer ribbons which provides space for both the ribbon and the take-up reel to be securely located as the ribbon and take-up reel are connected during the manufacturing process.

It is another object of the present invention to provide an apparatus for packaging thermal transfer ribbons which prevents rotation of the ribbon which may cause contamination or damage.

It is yet another object of the present invention to provide an apparatus for packaging thermal transfer ribbons which extends far enough beyond the edges of the ribbons so when shrink wrap is applied, pressure is applied evenly over the edge surfaces of the ribbon to avoid damaging any part of the ribbon, such as causing edge damage or affecting the curvature of the ribbon.

It is still another object of the present invention to provide an apparatus for packaging thermal transfer ribbons which is economical and easy to remove, so an operator can quickly access the undamaged ribbon for loading into a thermal transfer printer.

Accordingly, a packaging apparatus for packaging thermal transfer ribbons and other material having similar packaging requirements is provided. The packaging apparatus includes a pair of flat pieces having protrusions for locating pairs of thermal transfer ribbons and take-up reels in close proximity. The flat pieces and protrusions include features which prevent rotation, telescoping, edge damage or contamination of the thermal transfer ribbons during shipping processes.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figure 1:
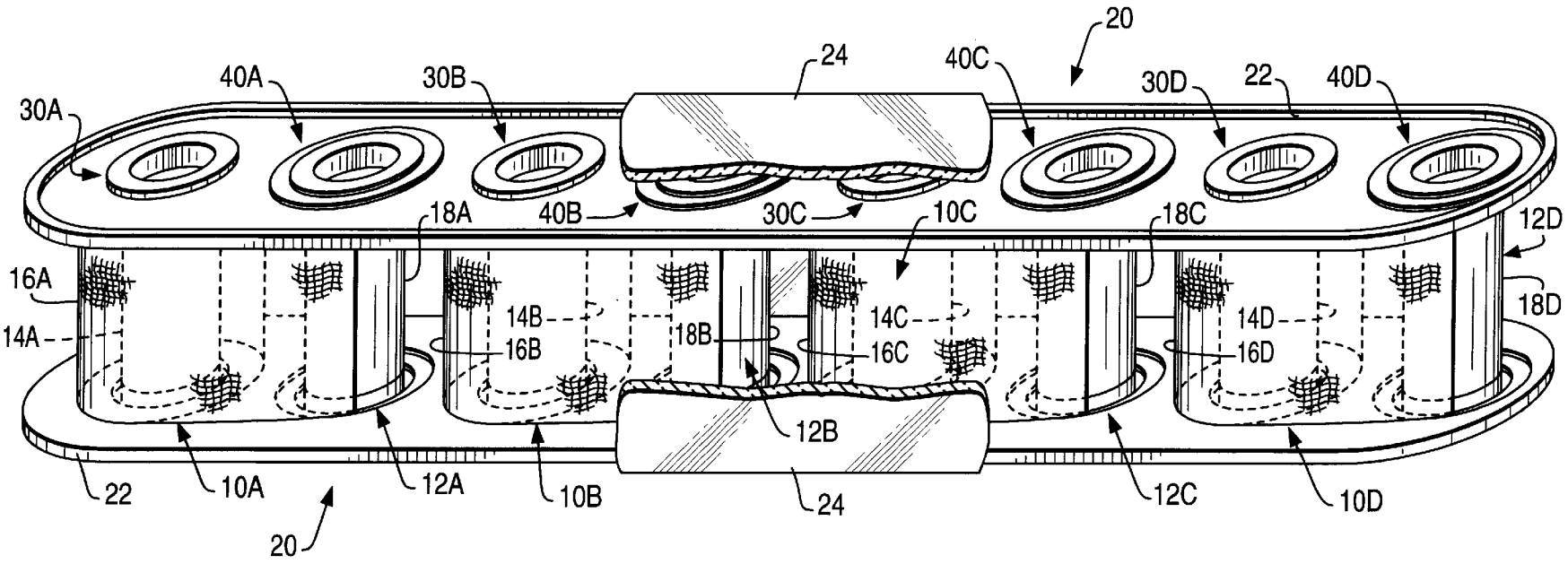
FIG. 1 shows thermal transfer ribbons and attached take-up reels packaged using the apparatus of the present invention.

Referring now to the drawings, in which like-referenced characters indicate corresponding elements throughout the several views, attention is first drawn to FIG. 1 which shows thermal transfer ribbons with attached take-up reels packaged using the apparatus of the present invention. This packaging apparatus can be used with any thermal transfer ribbons. An example of a thermal transfer ribbon is described in U.S. Pat. No. 5,248,652 issued on Sep. 28, 1993, to Shashi G. Talvalkar and assigned to NCR Corporation, herein incorporated by reference.

The packaging apparatus of the present invention comprises two flat pieces 20 which have features that are uniquely designed to hold a number of thermal transfer ribbons 10A–10D and take-up reels 12A–12D assemblies. Protrusions 30A–30D formed in each flat piece 20 hold the thermal transfer ribbon cores 14A–14D and protrusions 40A–40D formed in each flat piece 20 hold the take-up reel cores 18A–18D. Ribbon leaders 16A–16D connect thermal transfer ribbon cores 14A–14D and take-up reel cores 18A–18D. Each of the cores preferably has internal splines (longitudinal ribs extending along the inner diameter of the cores) to mate with the appropriate printer on which the thermal transfer ribbons and take-up reels are used. After the thermal transfer ribbon 10A–10D and take-up reels 12A–12D assemblies are positioned on the appropriate protrusions and between two flat pieces 20, heat shrink plastic wrap 24 or other form fitting wrapping material surrounds the outer surface of the flat pieces 20 and the space between the flat pieces 20 which is defined by the thermal transfer ribbons 10A–10D and take-up reels 12A–12D. Because of the unique protrusion design and spacing, wrapping material 24 holds the ribbons, take-up reels and flat pieces together to prevent contamination of the ribbon while not being so tight as to cause edge damage or other damage to the thermal transfer ribbons. (The term edge damage refers to the deforming, crinkling, or crushing of the ribbon's edge caused by pressure being applied at an angle to the edge or at an extremely high force.)

Figure 2A:
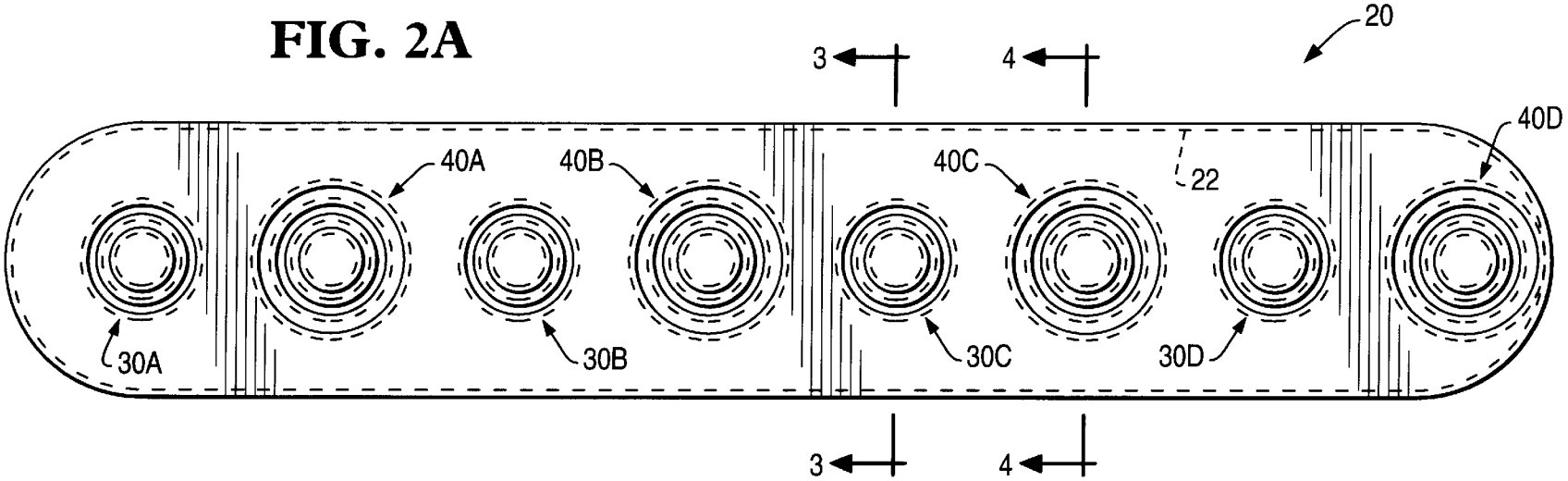
FIGS. 2A ad 2B show top and side views of one piece of the packaging apparatus of the present invention.
Figure 2B:
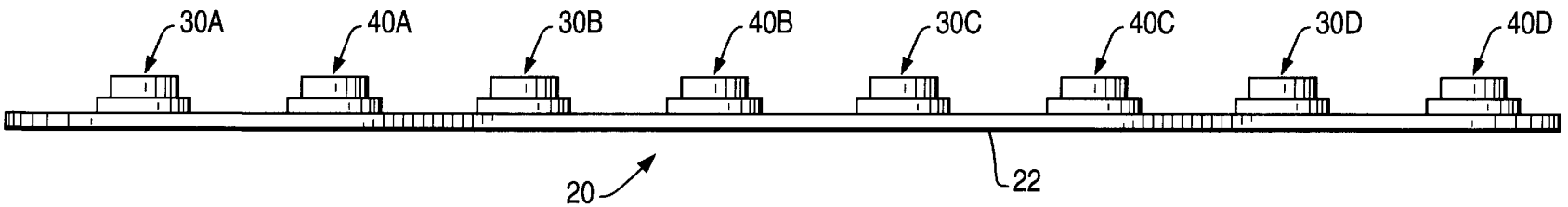

Now a more detailed discussion of the flat pieces 20 will be discussed referring to FIGS. 2A, 2B, 3 and 4. FIG. 2A shows a top view of a flat piece 20 including protrusions 30A–30D and 40A–40D. Flat piece 20 may be formed of any plastic such as ABS plastic which is relatively inexpensive and easy to mold. As seen in FIGS. 1 and 2A, flat pieces 20 are sized so that each flat piece 20 overhangs all ribbon and take-up reel assemblies. Each flat piece 20 has a reinforcing rib 22, so the flat pieces 20 are lightweight yet rigid enough to prevent damage to the ribbons. Each flat piece 20 has a curved radius at each end to prevent the heat shrink plastic wrap 24 from causing additional pressure on the ribbon located at the ends of the packaging apparatus. FIG. 2B shows a side view of flat piece 20.

Figure 3:
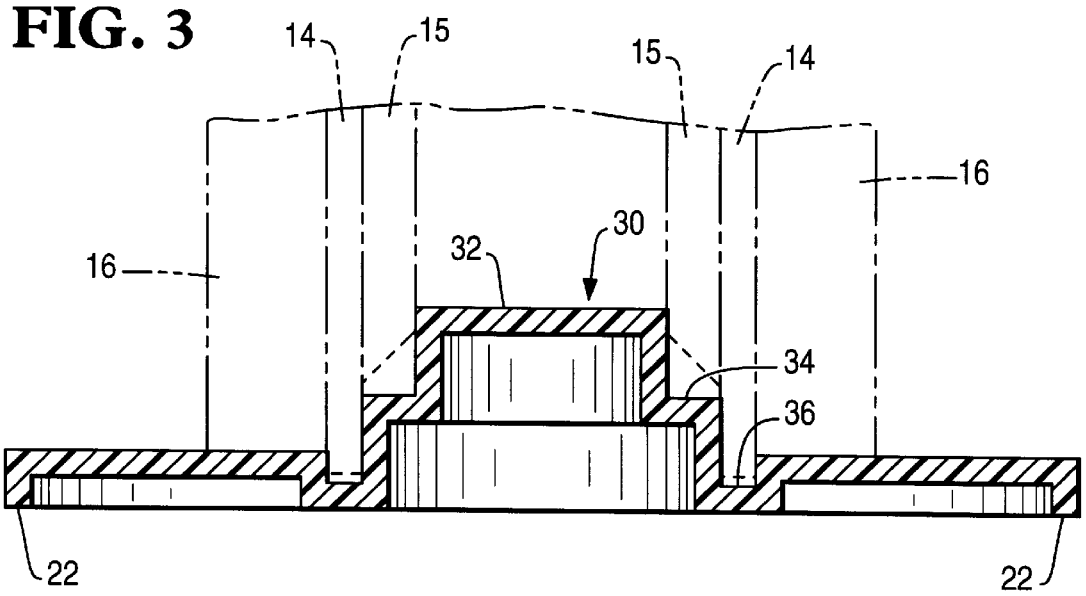
FIG. 3 shows a view along reference line 3—3 of FIG. 2A.

FIG. 3 shows a cross sectional view of a typical protrusion 30 for holding a ribbon in the packaging apparatus of the present invention. (The ribbon and core are shown in shadow lines to aid in understanding the various features of the protrusion.) Protrusion 30 includes a flat top 32 which extends into the hollow core of the ribbon and has a diameter less than the splines 15 located in the inner diameter of the core 14. A ledge 34 mates with the inside of the hollow core 14 below the splines to provide a secure fit. A recess 36 is provided to receive the edge of the core 14 of the ribbon which usually extends beyond the wound material. Obviously, if the core is flush with the edge of the wound material, the recess 36 may be unnecessary. As the ribbon core 14 is wrapped with several wounds of ribbon, the flat piece 20 fits against the edges of the ribbon so the core may not extend to the bottom of recess 36. As pressure is applied equally across the wound ribbon edges and perpendicular to the edges, the edges are not damaged by the packaging and the ribbon is held securely. Reinforcing ribs 22 are also shown.

Figure 4:
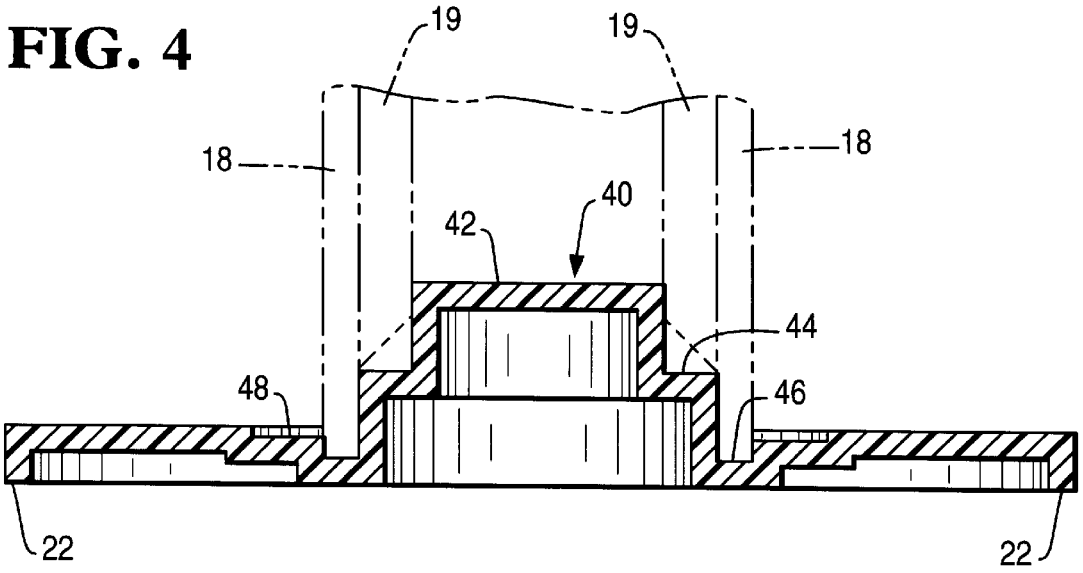
FIG. 4 shows a view along reference line 4—4 of FIG. 2A.

FIG. 4 shows a cross sectional view of a typical protrusion 40 for holding a take-up reel in the packaging apparatus of the present invention. (The take-up reel is shown in shadow lines to aid in understanding the various features of the protrusion.) Protrusion 40 includes a flat top 42 which extends into the hollow core of the take-up reel core 18 and has a diameter less than the splines 19 in the inner diameter of the core 18. A ledge 44 mates with the inside of the hollow core 18 below the splines to provide a secure fit. A recess 46 is provided to receive the edge of the core of the take-up reel. The core edge rests in the bottom of the recess because the core is heavier than the attached leader 16. Obviously, if the core is flush with the edge of the wound material, the recess may be unnecessary. A shallow ledge 48 provides clearance where the leader 16 of the ribbon is attached to the take-up reel core. The leader 16 of the ribbon attaches the ribbon and the take-up reel core. If the leader 16 is not exactly centered on the take-up reel core, shallow ledge 48 provides additional clearance so the leader 16 is not smashed or crinkled by the flat pieces 20. Reinforcing ribs 22 are also shown.

Figure 5:
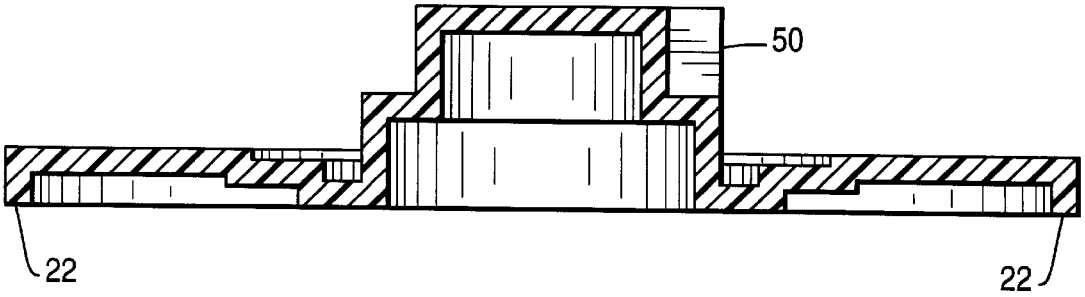
FIG. 5 shows a view along reference line 4—4 of FIG. 2A including a wing portion according to a second embodiment of the present invention.

FIG. 5 shows a side view of a protrusion such as that shown in FIG. 4 which includes a wing 50 on the protrusion to prevent rotation of the core placed about that protrusion. The wing 50 fits between the splines 19 in take-up reel core 18 to insure rotation is prevented. Other unique shapes may be used to prevent rotation instead of the wing. To assist the operator in locating the ribbon and attached take-up reel on the protrusions, it is preferred that the shapes to prevent rotation be located either on the ribbon protrusions or the take-up reel protrusions but not both. If anti-rotation shapes are included on both protrusions, it may be difficult to located both the ribbon and take-up reel and maintain a tightly rolled relation between the two cores.

Advantageously, the apparatus of the present invention includes interchangeable top and bottom pieces to assist operators in packaging the ribbons. Any feature of the flat piece may be a mirror image so that only one design exists.

Yet another advantage of the present invention is that the flat pieces are designed to require as little material as possible while still providing adequate structure to protect the ribbons from damage. Thus a lightweight packaging apparatus is provided.

Still another advantage of the present invention is that the packaging apparatus holds the ribbons and take-up reels in place so the protective wrap is only tight enough to hold the pieces together and not so tight as to damage the thermal transfer ribbons.

Although the present invention has been described with respect to thermal transfer ribbons, any other ribbon or other materials having similar packaging requirements are contemplated within the scope of the present invention.

Although the invention has been described with particular reference to certain preferred embodiments thereof, variations and modifications of the present invention can be effected within the spirit and scope of the following claims.

What is claimed is:

1. An apparatus for packaging thermal transfer ribbons and take-up reels attached by ribbon leaders and having cores which extend beyond the ribbons and leaders, comprising:

a pair of flat pieces having pairs of protrusions for locating each ribbon and take-up reel in close proximity, each one of said pairs of protrusions fitting the core of each ribbon and take-up reel, respectively, wherein each one of said protrusions fitting the core of the ribbon includes a first recess which is at least a predetermined length to accommodate the core of the ribbon so said pair of flat pieces fit against and in contact with the entire edges of each ribbon distributing pressure uniformly and wherein each one of said protrusions fitting the core of the take-up reel includes a second recess which is at least said predetermined length to accommodate the core of the ribbon and a third recess which provides clearance where the leader of the ribbon is attached to the take-up reel core.

2. A packaging apparatus, comprising:

a plurality of pairs of thermal transfer ribbons and take-up reels attached by ribbon leaders and having cores which extend beyond the ribbons and leaders; and a pair of flat pieces having pairs of protrusions for locating each pair of thermal transfer ribbons and attached take-up reels in close proximity, each one of said pairs of protrusions fitting the core of each thermal transfer ribbon and attached take-up reel, respectively, wherein each one of said protrusions fitting the core of the ribbon includes a first recess which is at least a predetermined length to accommodate the core of the ribbon so said pair of flat pieces fit against and in contact with the entire edges of each ribbon distributing pressure uniformly and wherein each one of said protrusions fitting the core of the take-up reel includes a second recess which is at least said predetermined length to accommodate the core of the ribbon and a third recess which provides clearance where the leader of the ribbon is attached to the take-up reel core.

3. The apparatus of claim 2 further comprising wrapping material for holding the pair of flat pieces and the plurality of pairs of thermal transfer ribbons and attached take-up reels together and for preventing debris from contaminating the thermal transfer ribbons.

* * * * *